US008931678B2

(12) United States Patent
Liu

(10) Patent No.: US 8,931,678 B2
(45) Date of Patent: Jan. 13, 2015

(54) PNEUMATIC TOOL HAVING A PASSAGE UNIT

(75) Inventor: Angi Liu, Taichung (TW)

(73) Assignee: Basso Industry Corp, Taichung (TW)

( * ) Notice: Subject to any disclaimer, the term of this patent is extended or adjusted under 35 U.S.C. 154(b) by 702 days.

(21) Appl. No.: 13/228,398

(22) Filed: Sep. 8, 2011

(65) Prior Publication Data

US 2012/0061445 A1 Mar. 15, 2012

(30) Foreign Application Priority Data

Sep. 13, 2010 (TW) ..... 99130853 A

(51) Int. Cl.
*B25C 1/04* (2006.01)

(52) U.S. Cl.
CPC ..... *B25C 1/042* (2013.01); *B25C 1/041* (2013.01); *B25C 1/047* (2013.01); *B25C 1/04* (2013.01); *B25C 1/043* (2013.01)
USPC ..... 227/130; 227/8

(58) Field of Classification Search
CPC ..... B21C 1/047; B21C 1/04; B21C 1/043; B21C 1/041; B21C 1/042
USPC ..... 227/8, 130
See application file for complete search history.

(56) References Cited

U.S. PATENT DOCUMENTS 6,745,928 B2 6/2004 Ishizawa et al.
7,341,174 B1 * 3/2008 Wen ..... 227/130

* cited by examiner

*Primary Examiner* — Michelle Lopez
(74) *Attorney, Agent, or Firm* — Ladas & Parry, LLP

(57) ABSTRACT

A pneumatic tool includes: a body; a pneumatic driving unit disposed in the body for performing pneumatically a fastener-driving operation; a trigger valve unit disposed on the body and adapted for controlling flow of air into the pneumatic driving unit and out of the body; and a passage unit formed in the body and including an air storing chamber adapted for guiding flow of air into the trigger valve unit, a bidirectional passage for intercommunicating the trigger valve unit and the pneumatic driving unit, an exhaust passage communicated with the trigger valve unit, and an expansion passage adapted for intercommunicating the exhaust passage and the atmosphere and extending along a peripheral portion of the body as to permit flow of air from the exhaust passage into the atmosphere therethrough.

7 Claims, 8 Drawing Sheets

PNEUMATIC TOOL HAVING A PASSAGE UNIT

CROSS-REFERENCE TO RELATED APPLICATIONS

This application claims priority to Taiwan Patent Application No. 99130853 filed on Sep. 13, 2010, the disclosure of which is incorporated herein by reference.

BACKGROUND OF THE INVENTION

1. Field of the Invention

The invention relates to a pneumatic tool, more particularly to a pneumatic tool with trigger valve control.

2. Description of the Related Art

Referring to FIGS. 1 and 2, in U.S. Pat. No. 6,745,928, there is disclosed a conventional pneumatic tool 1 that includes a body 11, an air cylinder 12 provided in the body 11, a shuttle valve 13 sealing the air cylinder 12, a trigger valve unit 14 provided in the body 11 for controlling directions of air flow, an exhaust passage 15 formed in the body 11 and in fluid communication with the trigger valve unit 14 and the atmosphere, an intake passage 16 formed in the body 11 and in fluid communication with the trigger valve unit 14 and a compressed air source, and a vent passage 17 formed in the body 11. The trigger valve unit 14 includes a valve seat 141, a plunger 142 extending through the valve seat 141, a valve piston 143 mounted between the valve seat 141 and the plunger 142, and a plurality of O-rings 144 mounted among the valve seat 141, the plunger 142 and the valve piston 143.

By exerting an external force on the plunger 142 and due to the pressure difference, the positions of the plunger 142 and the valve piston 143 can be changed to allow air to flow from the intake passage 16 through the trigger valve unit 14 and the vent passage 17 so as to act on the shuttle valve 13 to allow compressed air to flow into the cylinder 12 for performing a fastener-driving operation. After completion of the fastener-driving operation, the shuttle valve 13 is biased to return to its original position, and the air acting on the shuttle valve 13 flows in a reverse direction into the atmosphere through the vent passage 17, the trigger valve unit 14 and the exhaust passage 15.

However, since the air pressure of the pneumatic tool 1 is rather high, and since the total length of the intake passage 16, the vent passage 17 and the exhaust passage 15 is too short to buffer effectively the airflow, when the fastener-driving operation is performed, a noise so loud as not to be ignored is generated. Moreover, since the valve piston 143 must be provide with three O-rings 144 to serve the purpose of controlling the air flow directions, not only the number of the O-rings 144 is too many, but also the associated friction resistance turns out rather high.

SUMMARY OF THE INVENTION

The object of the present invention is to provide a pneumatic tool that can reduce noise generated during the fastener-driving operation.

Accordingly, a pneumatic tool of the present invention comprises a body, a pneumatic driving unit, a trigger valve unit and a passage unit. The pneumatic driving unit is disposed in the body for performing pneumatically a fastener-driving operation. The trigger valve unit is disposed on the body and adapted for controlling flow of air into the pneumatic driving unit and out of the body. The passage unit is formed in the body and includes an air storing chamber adapted for guiding flow of air into the trigger valve unit, a bidirectional passage for intercommunicating the trigger valve unit and the pneumatic driving unit, an exhaust passage communicated with the trigger valve unit, and an expansion passage that is adapted for intercommunicating the exhaust passage and the atmosphere and extending along a peripheral portion of the body. The expansion passage is adapted to permit flow of air from the exhaust passage into the atmosphere therethrough. The bidirectional passage is adapted for permitting flow of air between the trigger valve unit and the pneumatic driving unit therethrough in opposite directions.

The advantage of this invention is that, the expansion passage is disposed to permit flow of air from the exhaust passage into the atmosphere at a low pressure and flow speed to thereby serve the purpose of noise reduction.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
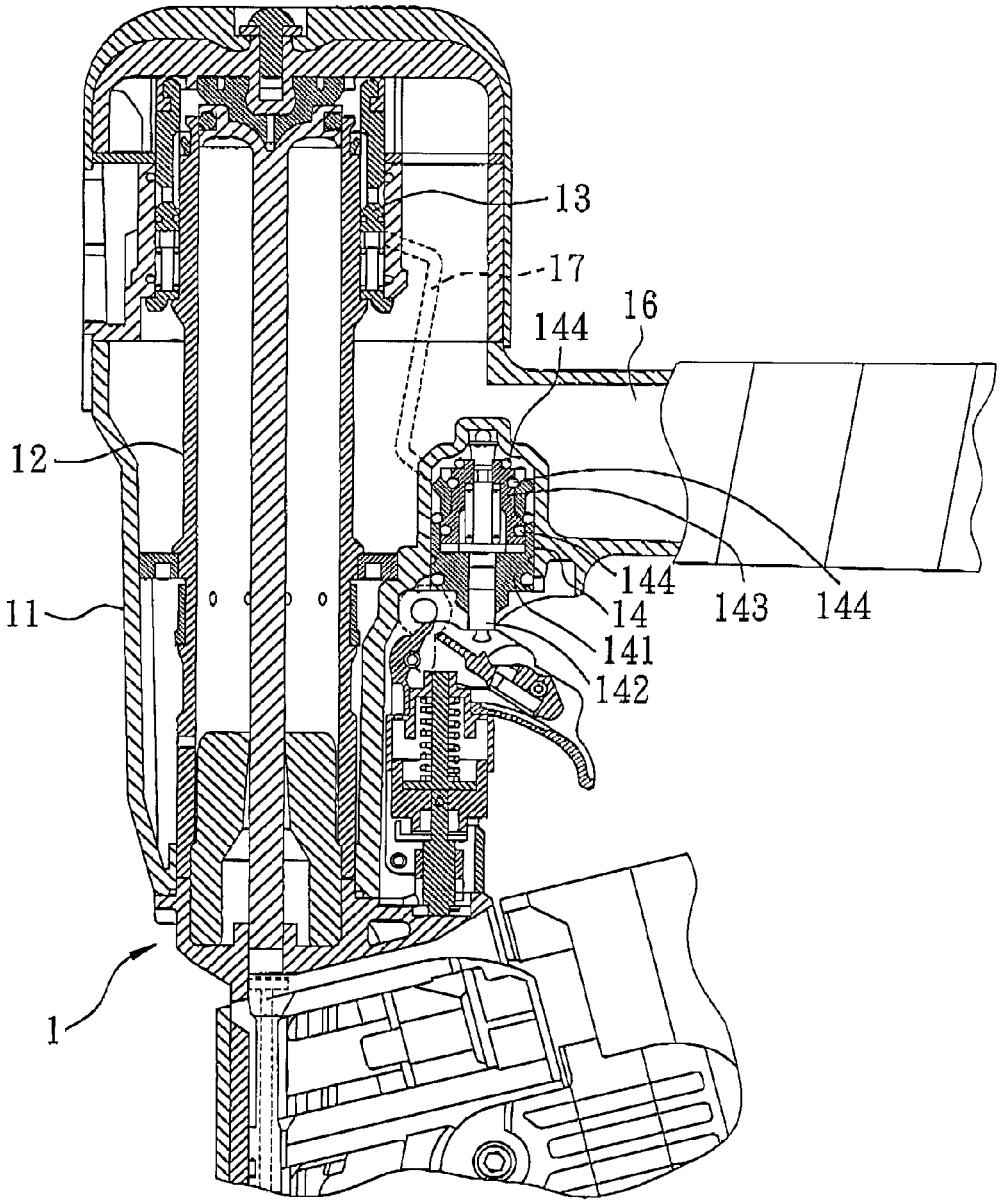
FIG. 1 PRIOR ART
FIG. 1 is a sectional side view illustrating a conventional pneumatic tool disclosed in the U.S. Pat. No. 6,745,928.
Figure 2:
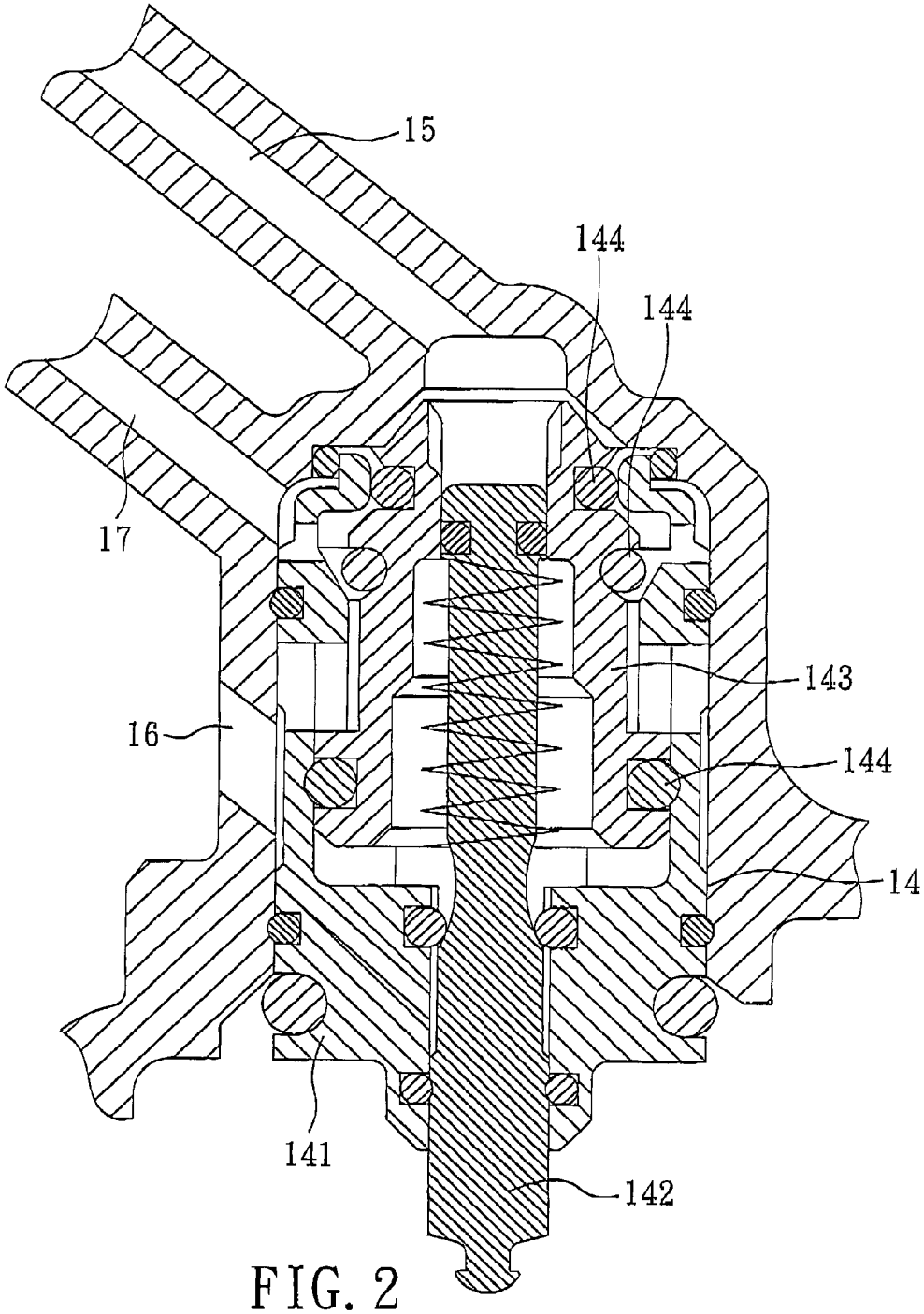
FIG. 2 PRIOR ART
FIG. 2 is another sectional side view illustrating the conventional pneumatic tool disclosed in the U.S. Pat. No. 6,745,928.
Figure 3:
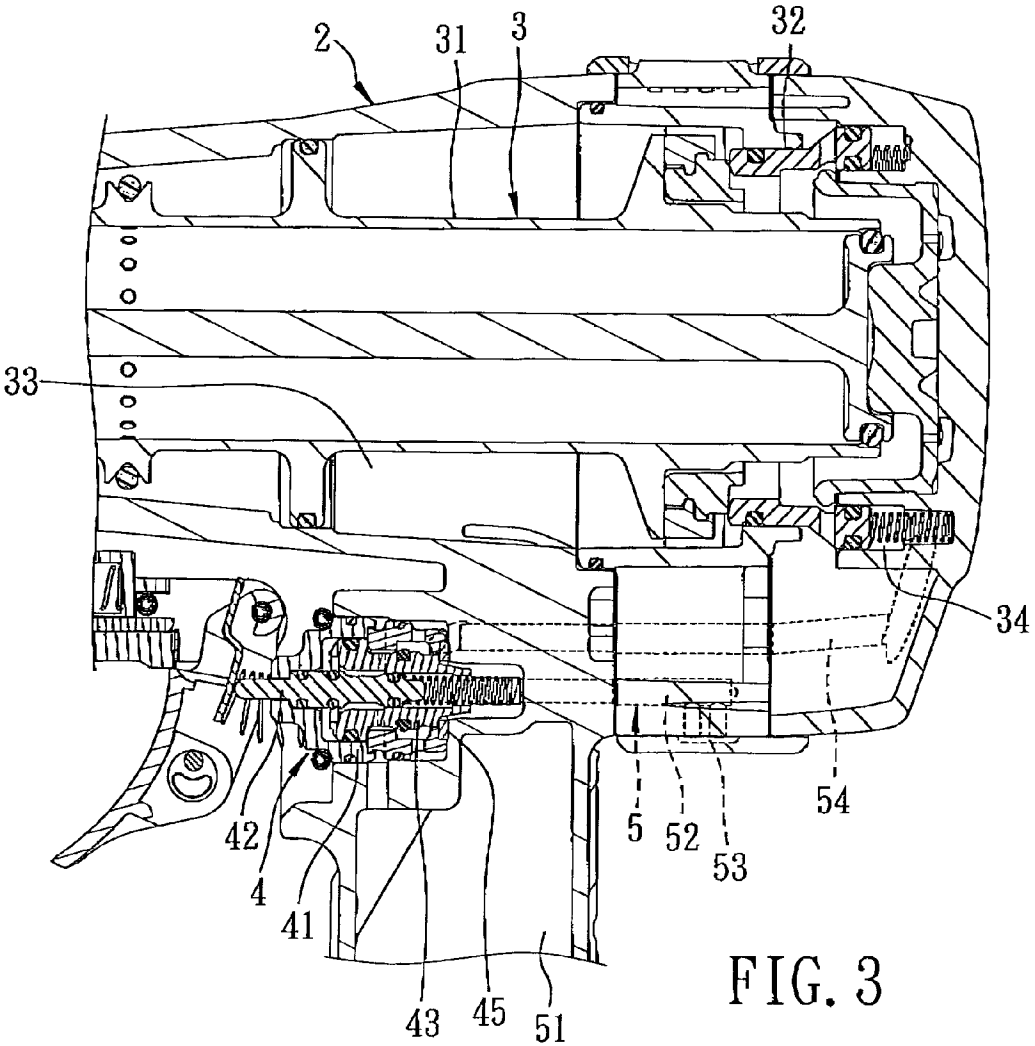
FIG. 3 is a sectional side view of the preferred embodiment of a pneumatic tool according to the present invention.
Figure 4:
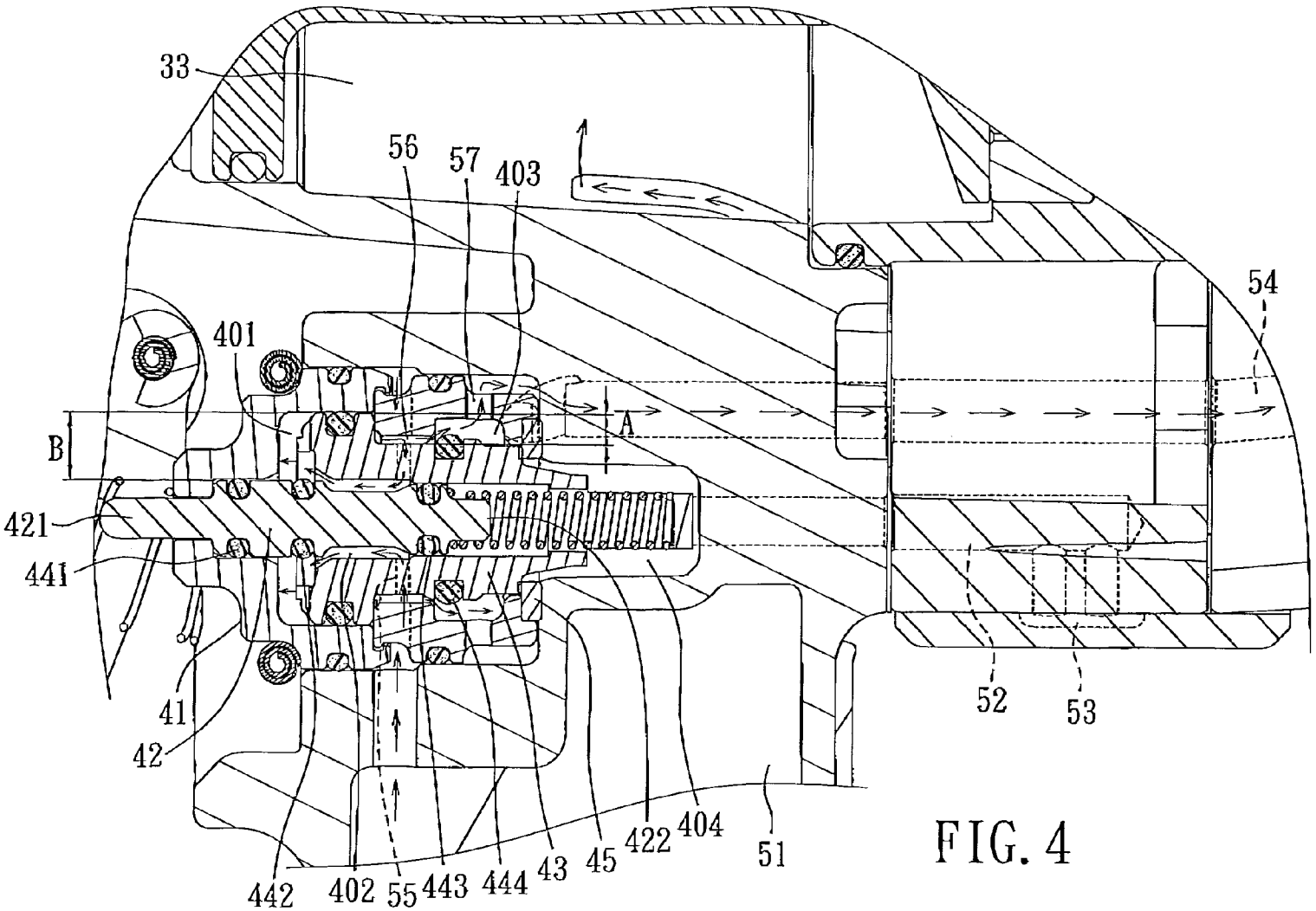
FIG. 4 is a fragmentary sectional side view of the preferred embodiment illustrating a trigger valve unit.
Figure 5:
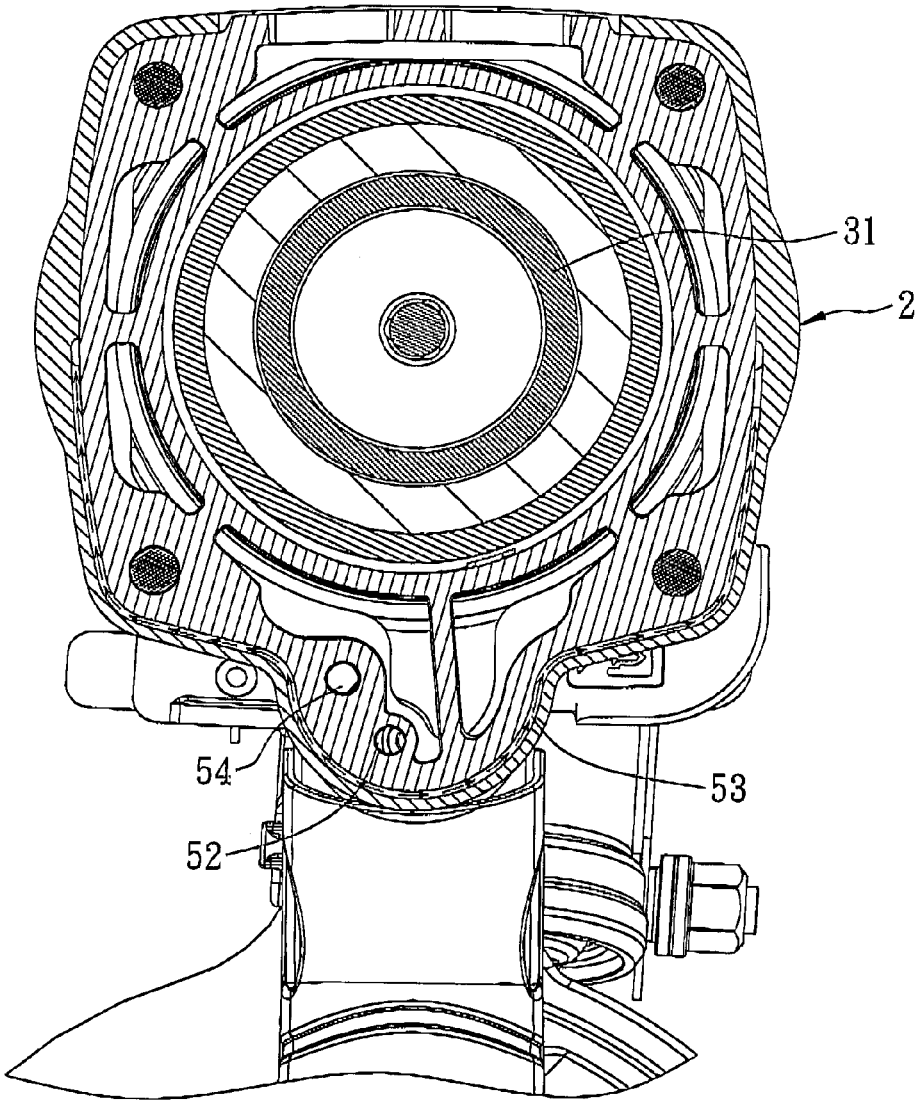
FIG. 5 is a fragmentary sectional view of the preferred embodiment illustrating an expansion passage.

As shown in FIGS. 3, 4 and 5, the preferred embodiment of a pneumatic tool according to the present invention includes a body 2, a pneumatic driving unit 3, a trigger valve unit 4 and a passage unit 5.

The pneumatic driving unit 3 is disposed in the body 2 and includes an air cylinder 31, a shuttle valve 32 disposed on the air cylinder 31 for controlling flow of air into the air cylinder 31, a high pressure chamber 33 formed in the body 2 and defined by a side of the shuttle valve 32, and a pressure difference chamber 34 formed in the body 2 and defined by an opposite side of the shuttle valve 32.

Figure 7:
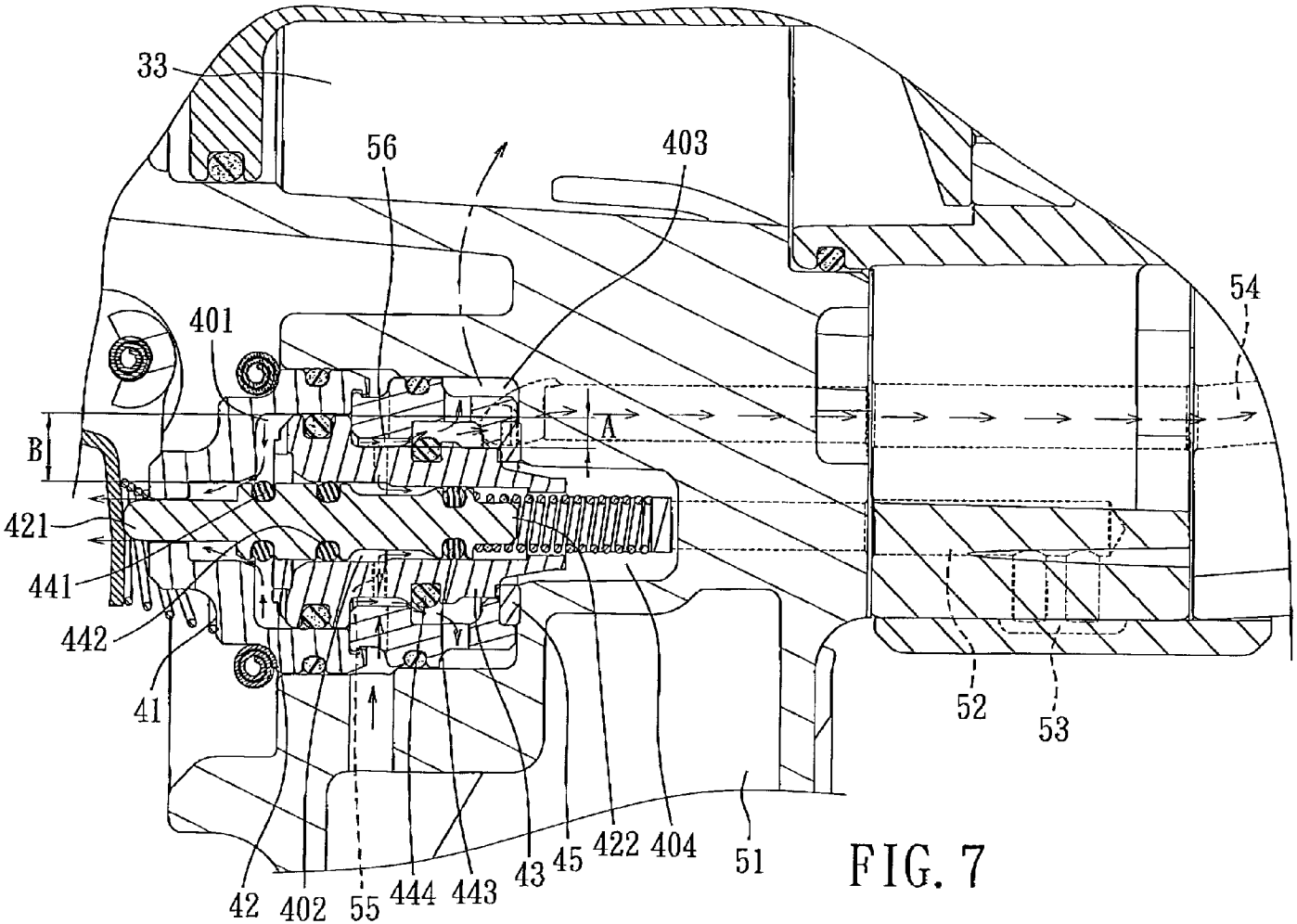
FIG. 7 is a fragmentary sectional view of the preferred embodiment illustrating that a valve rod moves from a first position to a second position.

The trigger valve unit 4 is disposed on the body 2 and includes a valve seat 41, a valve rod 42 movable within the valve seat 41 along an axis between a first position (as shown in FIG. 4) and a second position (as shown in FIG. 7), and an inner valve 43 disposed within the valve seat 41 and around the valve rod 42. The valve rod 42 has a front end 421 and a rear end 422. The trigger valve unit 4 further includes: a first air chamber 401 defined among the front end 421 of the valve rod 42, the inner valve 43, and the valve seat 41; a second air chamber 402 disposed behind the first air chamber 401, defined between the inner valve 43 and the valve rod 42, and communicated with the air storing chamber 51; a third air chamber 403 disposed behind the second air chamber 402 and defined between the inner valve 43 and the valve seat 41; and a fourth air chamber 404 disposed behind the third air chamber 403 and defined between the rear end 422 of the valve rod 42 and the inner valve 43. The trigger valve unit 4 further includes a first O-ring 441 sleeved on the valve rod 42, a second O-ring 442 sleeved on the valve rod 42 and spaced apart from the first O-ring 441, a third O-ring 443 sleeved on the valve rod 42 and spaced apart from the first and second O-rings 441, 492, a fourth O-ring 444 sleeved on the inner valve 43 and a sealing member 45 disposed on the valve seat 41 and in airtight contact with the inner valve 43.

The passage unit 5 is formed in the body 2 and includes an air storing chamber 51 guiding flow of air into the trigger valve unit 4 and in fluid communication with the second air chamber 402, a bidirectional passage 54 intercommunicating the trigger valve unit 4 and the pneumatic driving unit 3 and in fluid communication with the third air chamber 403, an exhaust passage 52 communicated with the trigger valve unit 4 and the fourth air chamber 404, an U-shaped expansion passage 53 intercommunicating the exhaust passage 52 and the atmosphere and extending along a peripheral portion of the body 2, a hole 55 formed in the valve seat 41 and intercommunicating the air storing chamber 51 and the second air chamber 402, an annular clearance 56 defined between the inner valve 43 and the valve seat 41 and intercommunicating the air storing chamber 51 and the third air chamber 403, and an annular passage 57 formed in the valve seat 41 and intercommunicating the third air chamber 403 and the bidirectional passage 54.

Referring to FIGS. 3 and 4, when in normal state, the valve rod 42 is not pressed and hence is disposed in the first position. At this position, the first O-ring 441 is in airtight contact with the valve seat 41 to interrupt airflow between the atmosphere and the first air chamber 401, the second O-ring 942 is removed from the inner valve 43 to allow for airflow between the first and second air chambers 401, 402, the third O-ring 443 is in airtight contact with the inner valve 43 to prevent airflow between second and fourth air chambers 402, 404, and the sealing member 45 is in airtight contact with the inner valve 43 to interrupt airflow between the third and fourth air chambers 403, 404.

Thereby, when compressed air flows through the air storing chamber 51 to enter directly the high pressure chamber 33, and into the second air chamber 402 and the third air chamber 403 through the hole 55 and the annular clearance 56, respectively, it fills the first air chamber 401, the second air chamber 402 and the third air chamber 403. In addition, compressed air also flows into the pressure difference chamber 34 through the annular passage 57. Since the air pressure in the high pressure chamber 33 and the pressure difference chamber 34 is kept in a balanced state, the shuttle valve 32 is biased to seal the air cylinder 31, and the high pressure chamber 33 is filled with compressed air when the pneumatic tool is connected with a compressed air source (not shown).

Figure 6:
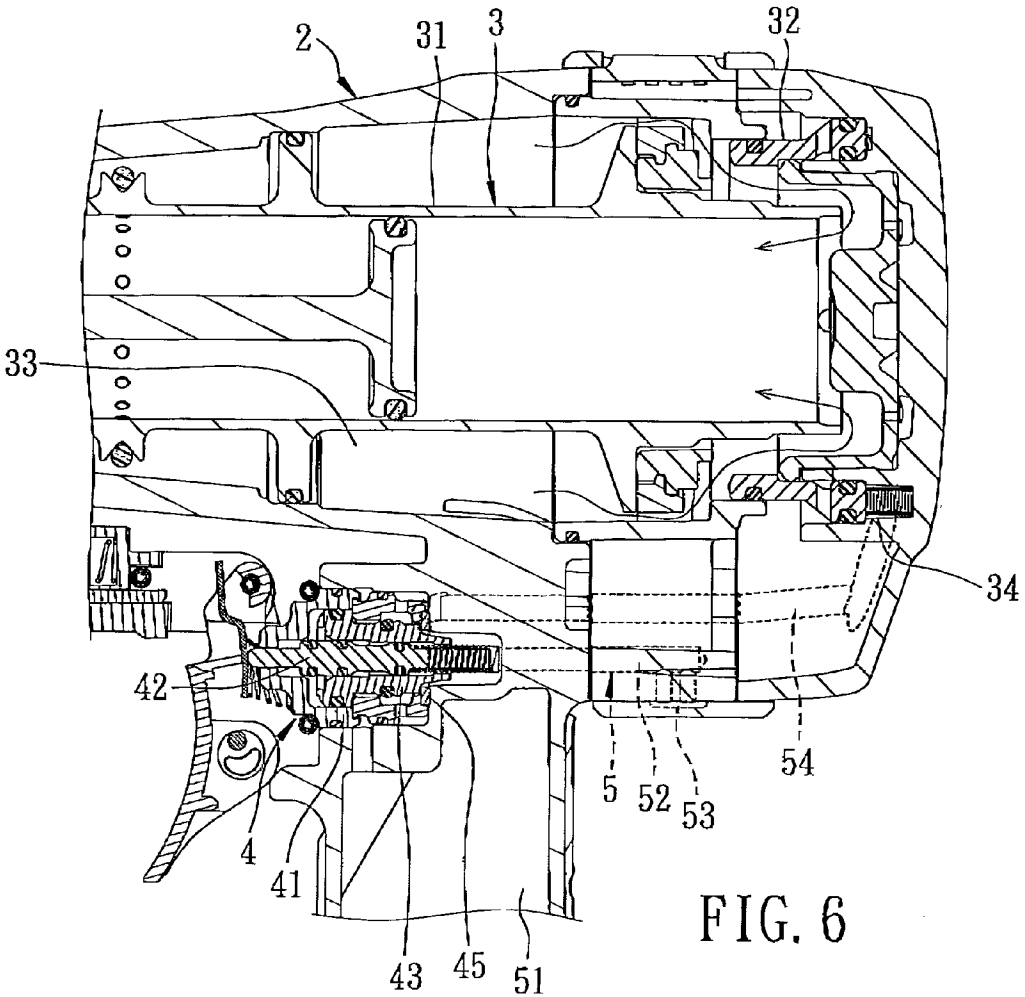
FIG. 6 is a sectional side view of the preferred embodiment illustrating that a shuttle valve is opened to allow for flow of air into an air cylinder.
Figure 8:
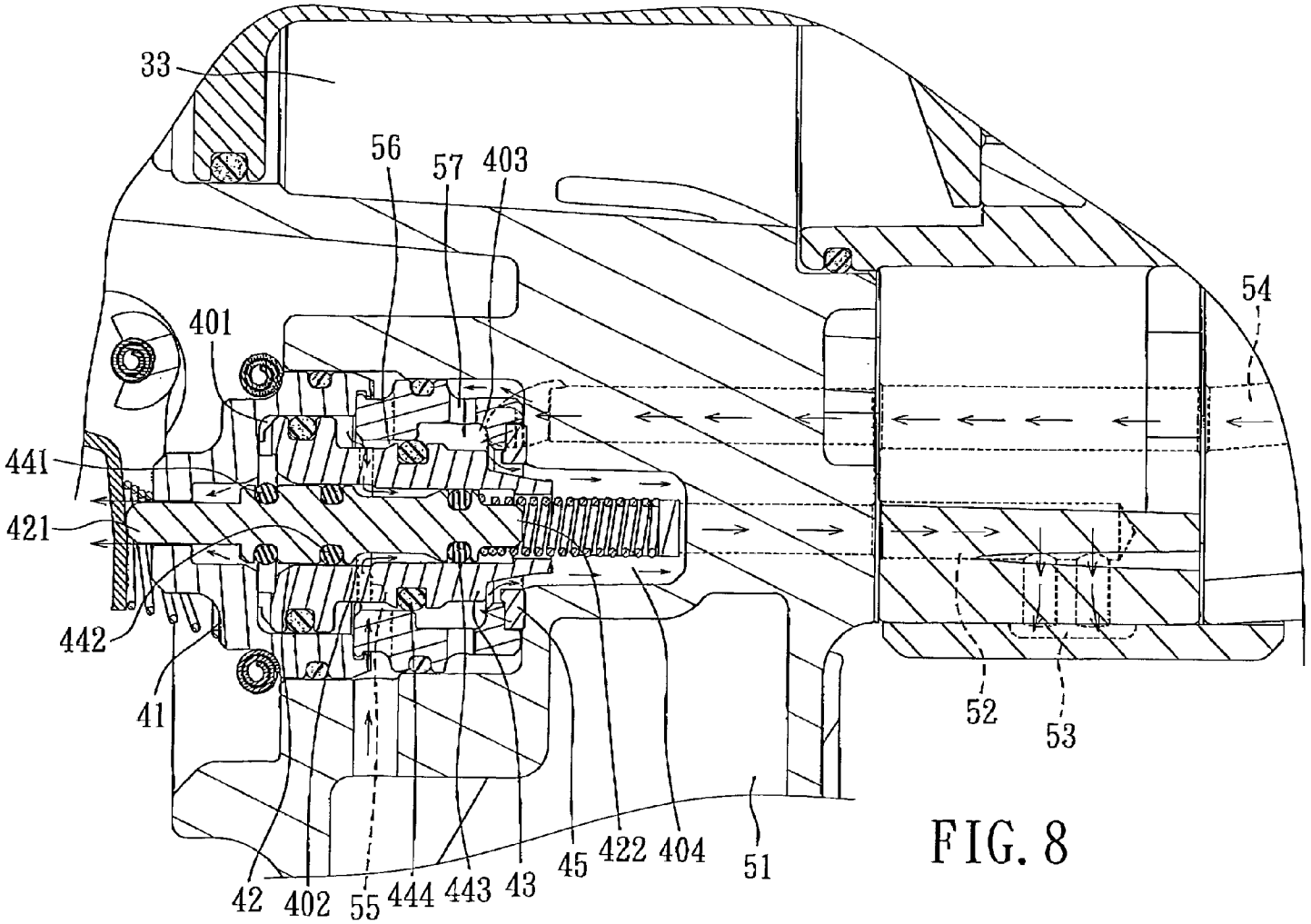
FIG. 8 is a fragmentary sectional view of the preferred embodiment illustrating that an inner valve is removed from a sealing member.

Referring to FIGS. 6, 7 and 8, during a fastener-driving operation, the valve rod 42 is pressed along the axis to move from the first position to the second position. At this moment, the first O-ring 441 is removed from the valve seat 41 to allow for airflow between the atmosphere and the first air chamber 401, and the second O-ring 442 is in airtight contact with the inner valve 43 to interrupt airflow between the first and second air chambers 401, 402. Hence, the inner valve 43 is removed from the sealing member 45 due to the pressure difference in view of the fact that, when in a normal state, since compressed air applies a pressure on both areas (A) and (B) of the inner valve 43, and since the area (B) has a larger size than the area (A), the inner valve 43 is driven to be in airtight contact with the sealing member 45; and when the first air chamber 401 is in fluid communication with the atmosphere and has the same air pressure as the atmosphere, the air pressure acting on the areas (A) is larger than that acting on the area (B), so that the inner valve 43 is removed from the sealing member 45). Also at the second position of the valve rod 42, the third air chamber 403 and the fourth air chamber 404 are in fluid communication with each other, and the fourth O-ring 444 is in airtight contact with the valve seat 41 to prevent airflow between second and third air chambers 402, 403.

During pressing of the valve rod 42, since the fourth air chamber 404 is disposed in a normal pressure state, there is no air pressure to hinder the movement of the valve rod 42. Referring to FIGS. 5, 6 and 8, after the valve rod 42 is pressed, since the pressure difference chamber 34, the bidirectional passage 54, the third air chamber 403, the fourth air chamber 404, the exhaust passage 52 and the expansion passage 53 are in fluid communication with the atmosphere, the air pressure in the high pressure chamber 33 is larger than that in the pressure difference chamber 34, so that the air in the high pressure chamber 33 pushes and removes the shuttle valve 32 from the air cylinder 31 to allow compressed air to flow into the air cylinder 31 for performing the fastener-driving operation. Hence, the shuttle valve 32 pushes and moves the air in the pressure difference chamber 34 into the third air chamber 403 through the bidirectional passage 54 and the annular passage 57.

Consequently, air is discharged from the third air chamber 403 into the atmosphere along a flow path including the fourth air chamber 404, the exhaust passage 52, and the expansion passage 53.

From the foregoing, the pneumatic tool of this invention has the following advantages:

1. The bidirectional passage 54, the exhaust passage 52 and the expansion passage 53 can be long enough to buffer effectively the airflow so as to reduce air pressure and flow speed to thereby serve the purpose of reducing noise and increasing comfort in the working environment.

2. The inner valve 43 cooperates with the sealing member 45 to control opening and closing of the shuttle valve 23, and only one O-ring (i.e., the fourth O-ring 444) is provided on the inner valve 32, so as to simplify largely the structure of the trigger valve unit 4. Moreover, the fourth O-ring 444 cannot contact the valve seat 41 to facilitate smooth movement of the inner valve 43.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A pneumatic tool comprising:

a body;

a pneumatic driving unit disposed in said body for performing pneumatically a fastener-driving operation;

a trigger valve unit disposed on said body and adapted for controlling flow of air into said pneumatic driving unit and out of said body; and a passage unit formed in said body and including an air storing chamber adapted for guiding flow of air into said trigger valve unit, a bidirectional passage for intercommunicating said trigger valve unit and said pneumatic driving unit, an exhaust passage communicated with said trigger valve unit, and a U-shaped expansion passage adapted for intercommunicating said exhaust passage and the atmosphere and extending along a peripheral portion of said body, said expansion passage being adapted to permit flow of air from said exhaust passage into the atmosphere therethrough, said bidirectional passage being adapted for permitting flow of air between said trigger valve unit and said pneumatic driving unit therethrough in opposite directions.

2. The pneumatic tool as claimed in claim 1, wherein said pneumatic driving unit includes an air cylinder, and a shuttle valve disposed on said air cylinder for controlling flow of air into said air cylinder, said trigger valve unit including a valve seat, a valve rod movable within said valve seat along an axis between first and second positions, and an inner valve disposed within said valve seat and around the valve rod such that, when said valve rod is disposed at the first position, said shuttle valve is closed to thereby prevent flow of air into said air cylinder, and when said valve rod is disposed at the second position, said shuttle valve is opened to thereby allow for flow of air into said air cylinder.

3. The pneumatic tool as claimed in claim 2, wherein said trigger valve unit further includes a sealing member disposed on said valve seat and in airtight contact with said inner valve for preventing flow of air between said bidirectional passage and said exhaust passage, said inner valve being removable from said sealing member to allow for flow of air between said bidirectional passage and said exhaust passage.

4. The pneumatic tool as claimed in claim 2, wherein said pneumatic driving unit further includes a high pressure chamber formed in said body and defined by one of two opposite sides of said shuttle valve, and a pressure difference chamber formed in said body and defined by the other of said two opposite sides of said shuttle valve, said pressure difference chamber being communicated with said expansion passage, said high pressure chamber being communicated with said air storing chamber, said shuttle valve compressing and moving air within said pressure difference chamber toward said expansion passage when said valve rod is disposed at the second position.

5. The pneumatic tool as claimed in claim 4, wherein:

said valve rod has a front end and a rear end; and said trigger valve unit further includes a first air chamber defined among said front end of said valve rod, said inner valve, and said valve seat, a second air chamber disposed behind said first air chamber, defined between said inner valve and said valve rod, and communicated with said air storing chamber, a third air chamber disposed behind said second air chamber, defined between said inner valve and said valve seat, and communicated with said bidirectional passage, and a fourth air chamber disposed behind said third air chamber, defined between said rear end of said valve rod and said inner valve, and communicated with said exhaust passage such that, when said valve rod is disposed at the first position, air flows from said second air chamber into said first and third air chambers, through said bidirectional passage and into said pressure difference chamber, and when valve rod is disposed at the second position, airflow between said first and second air chambers is interrupted, said first air chamber is communicated with the atmosphere, said inner valve is moved in said body, and airflow between said third and fourth air chambers is allowed, so that air is discharged from the air cylinder into the atmosphere through said bidirectional passage, said third and fourth air chambers, said exhaust passage, and said expansion passage.

6. The pneumatic tool as claimed in claim 5, wherein said trigger valve unit further includes a first O-ring sleeved on said valve rod, a second O-ring sleeved on said valve rod and spaced apart from said first O-ring, a third O-ring sleeved on said valve rod and spaced apart from said first and second O-rings, a sealing member disposed on said valve seat, and a fourth O-ring sleeved on said inner valve, said first O-ring being in airtight contact with said valve seat to interrupt airflow between the atmosphere and said first air chamber when said valve rod is disposed at the first position, said first O-ring being removed from said valve seat to allow for airflow between the atmosphere and said first air chamber when said valve rod is disposed at the second position, said second O-ring being in airtight contact with said inner valve to interrupt airflow between the first and second air chambers when said valve rod is disposed at the second position, said second O-ring being removed from said inner valve to allow for airflow between said first and second air chambers when said valve rod is disposed at the first position, said third O-ring being in airtight contact with the inner valve to prevent airflow between second and fourth air chambers, said sealing member being in airtight contact with said inner valve to interrupt airflow between said third and fourth air chambers, said inner valve being removable from said sealing member so as to allow for airflow between said third and fourth air chambers and so that said fourth O-ring comes into contact with said valve seat to thereby interrupt airflow between said second and third air chambers.

7. The pneumatic tool as claimed in claim 6, wherein said passage unit further includes a hole formed in said valve seat and intercommunicating said air storing chamber and said second air chamber, an annular clearance defined between said inner valve and said valve seat and intercommunicating said air storing chamber and said third air chamber, and an annular passage formed in said valve seat and intercommunicating said third air chamber and said bidirectional passage.

* * * * *